US005214257A

United States Patent [19]

Riskey

[11] Patent Number: 5,214,257

[45] Date of Patent: May 25, 1993

[54] TUB-SHAPED PACKAGING CONTAINER FOR MICROWAVE POPCORN

[75] Inventor: Dwight R. Riskey, Plano, Tex.

[73] Assignee: Recot, Inc., Plano, Tex.

[21] Appl. No.: 553,841

[22] Filed: Jul. 18, 1990

[51] Int. Cl.[5] ..... H05B 6/80

[52] U.S. Cl. ..... 219/10.55 E; 219/10.55 F; 426/107; 426/113; 426/234; 426/243; 99/DIG. 14

[58] Field of Search ..... 219/10.55 G, 10.55 F; 426/107, 109, 110, 111, 113, 115, 234, 243; 99/DIG. 14

[56] References Cited

U.S. PATENT DOCUMENTS

| | | | |
|---|---|---|---|
| D. 206,358 | 11/1966 | Griese . | |
| D. 221,625 | 8/1971 | Kinney et al. . | |
| D. 280,075 | 8/1985 | Haag, Sr. . | |
| 3,969,535 | 7/1976 | Bourns | 426/111 |
| 4,038,425 | 7/1977 | Brandberg et al. | 426/107 |
| 4,219,573 | 8/1980 | Borek | 426/107 |
| 4,248,901 | 2/1981 | Austin | 426/119 |
| 4,260,101 | 4/1981 | Webinger | 426/111 |
| 4,292,332 | 9/1981 | McHam | 426/111 |
| 4,448,309 | 5/1984 | Roccaforte et al. | 426/107 |
| 4,453,665 | 6/1984 | Roccaforte et al. | 426/107 |
| 4,477,705 | 10/1984 | Danley et al. | 219/10.55 E |
| 4,553,010 | 11/1985 | Bohrer et al. | 219/10.55 E |
| 4,584,202 | 4/1986 | Roccaforte | 426/111 |
| 4,586,649 | 5/1986 | Webinger | 426/111 |
| 4,678,882 | 7/1987 | Bohrer et al. | 219/10.55 E |
| 4,734,288 | 3/1988 | Engstrom et al. | 426/107 |
| 4,810,844 | 3/1989 | Anderson | 219/10.55 E |
| 4,861,958 | 8/1989 | Bohrer et al. | 219/10.55 E |
| 4,864,090 | 9/1989 | Maxwell et al. | 219/10.55 E |
| 4,959,231 | 9/1990 | Lakey et al. | 426/111 |
| 5,008,024 | 4/1991 | Watkins | 219/10.55 E |
| 5,045,659 | 9/1991 | Wolfe et al. | 219/10.55 E |
| 5,081,330 | 1/1992 | Brandberg et al. | 219/10.55 E |
| 5,097,107 | 3/1992 | Watkins et al. | 219/10.55 E |

FOREIGN PATENT DOCUMENTS 54-59168 11/1980 Japan .

*Primary Examiner*—Philip H. Leung
*Attorney, Agent, or Firm*—Rothwell, Figg, Ernst & Kurz

[57] ABSTRACT

A tub-shaped popcorn container has frusto-conical side walls to enable stacking and multiple packages, the walls of the tub provide a carrier for graphics. A pop bag containing liquid oil, seasoning and pop corn is carried in the bottom of the tub above a built-in heat susceptor, and a package lid may be provided which rises as the popcorn pops.

8 Claims, 2 Drawing Sheets

TUB-SHAPED PACKAGING CONTAINER FOR MICROWAVE POPCORN

BACKGROUND OF THE INVENTION

1. Field of the Invention

This invention relates to improvements in disposable containers for shipping, storing, selling and popping popcorn in a microwave oven and, in particular, to a tub-shaped disposable paperboard container for microwave popcorn.

2. Prior Art

With the popularization of microwave ovens and microwave cooking, numerous advances have been made in the field of packaging containers, which containers package the popcorn and the popcorn is cooked in the package (popped) in a microwave oven. With the present state of the art, microwave popcorn is at a parity with or even preferred relative to any other form of popcorn and the container in which the popcorn is packaged, stored, sold, used and then disposed of is quite important as the container must be functionally advantageous for each stage of its existence. That is, the container must be capable of receiving the popcorn seasoning and butter and hold it during the limit of shelf life of the product without leaking or damage. For sales purposes the packaging must be able to retain significant graphics. For popping, the packaging must have suitable heat susceptors for supplying the heat, and allow for expansion of popping corn while preventing burning. In use, the packaging must be such that the user does not burn his or her hands when opening the package.

Numerous microwave popcorn packages are known in the patented art. See, for example, U.S. Pat. Nos. 4,038,425; 4,219,573; 4,248,901, 4,260,101; 4,292,332; 4,453,665; 4,477,705; 4,448,309; 4,553,010; 4,584,202; 4,586,649; 4,678,882; 4,734,288; 4,810,844; 4,861,958; and 4,864,090.

Prior to the popularity of microwave popcorn, containers for selling and popping popcorn in a single package made of metal were known, as shown for example in U.S. Pat. No. 3,969,535 which refers to popping of popcorn in metal foil pans with expansible covers.

It is generally agreed that the "best" popcorn container is the "tub" used in movie theatres. This is because the container is easy to hold, it stands up by itself, it doesn't spill, it doesn't leak grease onto the hands, clothes, or furniture and it insulates heat away from the hands.

There is a need in the art for a combined shipping and popping package for microwave popcorn which utilizes all the advantages of the well known tub-shaped popcorn container.

SUMMARY OF THE INVENTION

This invention provides a microwave popcorn packaging container in the general shape of a tub such as used in movie theatres. Carried within the tub is a further sealed container in the form of a "pop bag" which holds liquid oil with the popcorn and seasoning on the bottom of the tub so it doesn't leak through the container. To effect popping of the popcorn in a microwave oven, a heat susceptor is placed on the bottom of the tub. The outer surface of the tub is a great carrier for graphics providing shelf impact better than that known in the market. The tub itself is made of microwave transmissive material which is insulating and does not leak the oil through the container. The tub can be stacked for shipping and sale in multiple units. The use of a liquid oil in the popcorn/oil/seasoning mixture rather than a slug of solid/semi-solid fat is a further advantage to the consumer. Whether sold in one pack or multi-packs, the entire package can be overwrapped in cellophane or the like. Additionally, a movable lid may be placed over the corn to rise during expansion of the corn during popping.

DETAILED DESCRIPTION OF THE PREFERRED EMBODIMENTS

Figure 1:
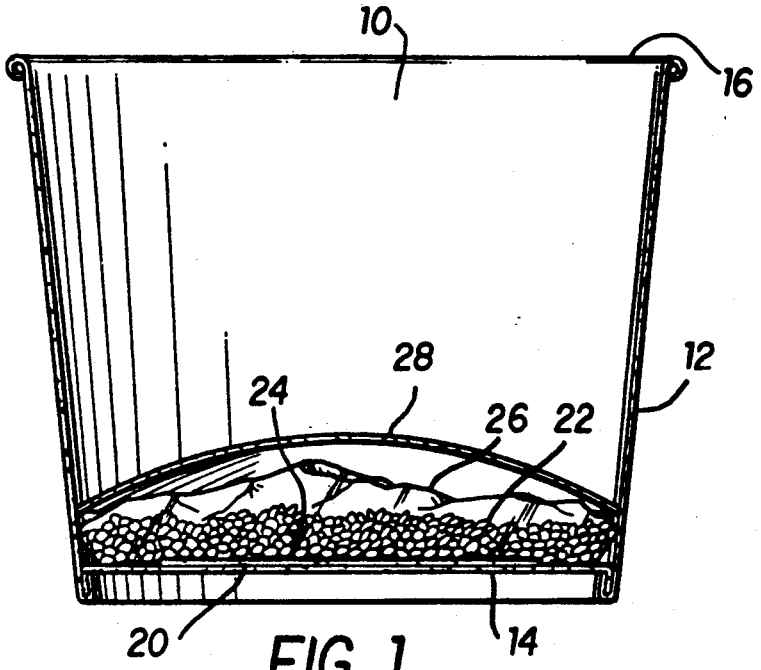
FIG. 1 is a elevation view of a package of this invention in section showing the corn/seasoning/liquid oil in a pop bag and a movable lid.

With reference to the drawings, in FIG. 1 there is a shown a tub-like container 10, that is, a container with frusto-conical shaped side walls 12 and a solid bottom 14 having an open top 16 at the top of the side wall 12. The tub may be constructed of paperboard which is insulating and is non-transmissive to butter and like fats such as used in movie theatres. The outer surface 11 of side walls 12 provides a highly desirable place for the addition of indicia or graphics 18, such indicia or graphics have great shelf impact and assist in consumer perception.

Within, carried by, or adjacent the bottom 14 there is a heat susceptor 20 of a type well known in the microwave popcorn art. The package 10 other than the heat susceptor is microwave transmissive and the heat susceptor provides the heat for popping the popcorn when subject to microwaves in a microwave oven as is well known in the art.

Raw popcorn kernels 22 in a liquid mixture of seasoning and oil 24 is contained in a liquid-proof but openable upon expansion "pop bag" 26. If desired, the microwave susceptor could be contained within the pop bag and the pop bag may, for example, be of the type disclosed in U.S. Pat. No. 4,810,844 granted Mar. 7, 1989. Of course, the bag itself must be transparent to microwave energy and capable of holding the liquid oil without leaking as well as being able to withstand temperatures reached during the microwave cooking of the popcorn ingredients.

Figure 3:
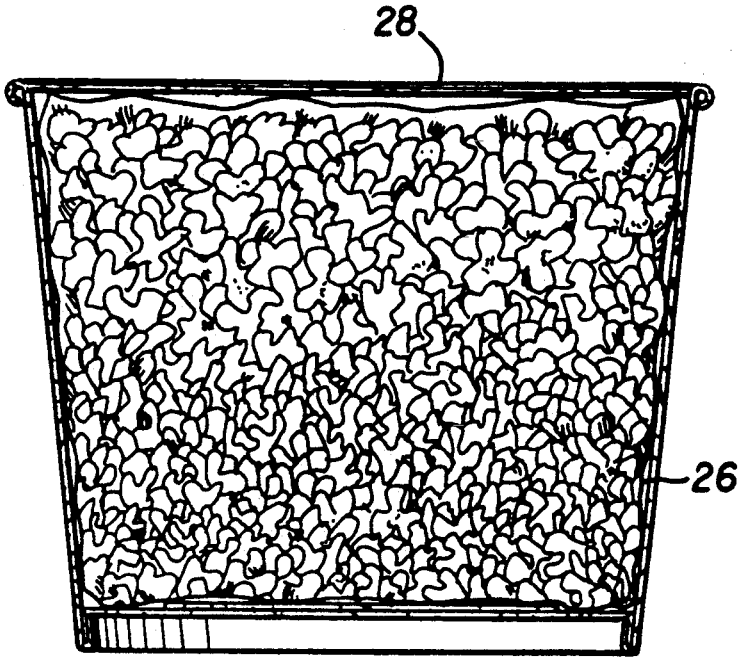
FIG. 3 is a side elevation view in section of the container of FIG. 3 after the popcorn is popped.

A lid 28 may be placed over the pop bag and the lid is configured so that during expansion, it will rise, flatten out and eventually rise to the top and assume the position shown in FIG. 3 in which the end of the popcorn popping process is shown with the pop bag 26 opened and the top 28 in place. At that time, the package may be shaken to further disseminate the seasoning and oil throughout the popcorn. The lid may then be removed for eating the popcorn. The use of a lid is optional.

Figure 4:
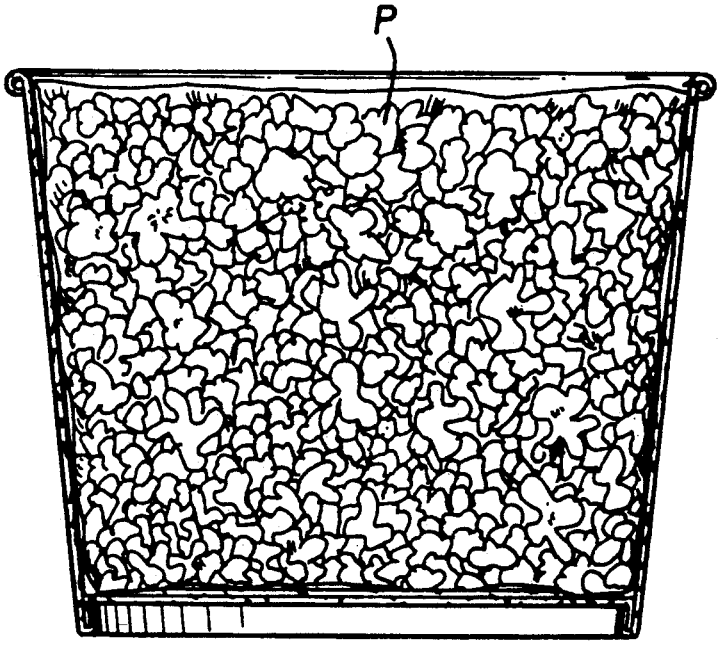
FIG. 4 is a further embodiment of the container after the popcorn is popped in which there is no top.

FIG. 4 shows a condition of the package after the lid 28 is removed, of if no lid is used, showing the seasoned popcorn p in condition to be eaten.

Figure 2:
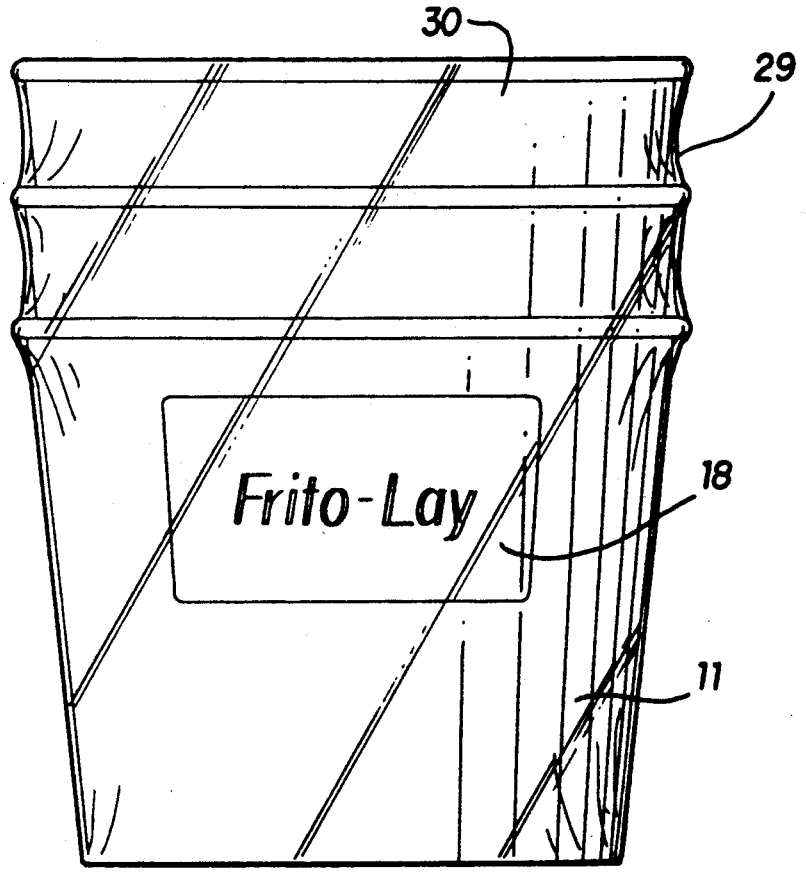
FIG. 2 illustrates multiple packages of this invention sticked together with a cellophane overwrap.

As indicated in FIG. 2, the tapered shape of the tub 10 allows stacking in multiple packs such as a threepack container 29 which is wrapped with a cellophane or other suitable, preferably transparent, overwrap 30.

As can be seen, the microwave popcorn container of this invention utilizes the undisputed best popcorn tub-shaped container as used in theatres which is easy to hold, stands up by itself, doesn't spill and doesn't leak the grease onto the hands, clothes or furniture, while it also insulates the heat. Additionally, the shape of the container allows stacking and for shipping in multiple packs. It also provides an excellent surface for graphics right on the delivery package itself which provides unique shelf impact. The fact that liquid unsaturated fats such as Canola oil can be used in the pop bag with the popcorn/seasoning mixture is an important but very unique point of consumer value.

I claim:

1. A packaging container for microwave popcorn package comprising:

(a) a cylindrical tub having side walls of frusto-conical shape, a solid bottom and an open top, the tub being constructed from materials which are microwave transmissive;

(b) a heat susceptor adjacent the bottom of such tub to provide heat when the tub is placed in the microwave oven for the purpose of popping corn;

(c) a separate pop bag of popping corn, seasoning and liquid oil positioned in the bottom of the tub adjacent the heat susceptor; and (d) a lid inside the tub positioned over the pop bag, the lid being movable upwardly under expansion forces of popping corn from the pop bag.

2. A packaging container as defined in claim 1 wherein the lid is slidably engaged with an inner surface of the side walls of the cylindrical tub.

3. A package of a plurality of containers for packaging and popping microwave popcorn comprising:

(a) a plurality of cylindrical tubs having side walls of frusto-conical shape, a solid bottom and an open top, each tub being constructed from materials which are microwave transmissive and having a heat susceptor adjacent the bottom portion thereof, the tubs being stacked in one another;

(b) a separate bag of popping corn, seasoning and liquid oil positioned in the bottom of each tub; and (c) a plastic see-through overwrap surrounding the multiple package of stacked tubs.

4. A package for popcorn capable of being popped with microwave energy in a microwave oven, the package being capable of stacking and comprising:

(a) a tub of generally frusto-conical shaped side walls, a solid bottom and an open top, the tub being constructed of materials which insulate the heat of the popcorn from the hands, prevent the transmission of grease from the popcorn through the walls, and are microwave transmissive;

(b) heat susceptor means adjacent the solid bottom wall of the tub to provide the heat for popping corn when the tub is placed in the microwave oven;

(c) a separate bag constructed of material which will not leak liquid oil but which will open on expansion of pressure from within and being microwave transmissive;

(d) popping corn seasoning and liquid oil contained and sealed within the separate bag, and the separate bag with the edible ingredients being positioned in the bottom of the tub.

5. A packaging container as defined in claim 4 further comprising a lid positioned over the bag, the lid being movable upwardly on expansion of popping corn.

6. A package as defined in claim 5 wherein the lid is slidably engaged with an inner surface of the side walls of the cylindrical tub.

7. A package as defined in claim 4 wherein a multiplicity of packages are stacked one on another and covered with an overwrap and the side walls of the packages contain graphics related to the contents of the pop bag.

8. A packaging container for microwave popcorn, comprising;

(a) a cylindrical tub having side walls of frusto-conical shape, a solid bottom and an open top, the tub being constructed from materials which are microwave transmissive;

(b) a heat susceptor adjacent the bottom of such tub to provide heat when the tub is placed in the microwave oven for the purpose of popping corn;

(c) popping corn and oil disposed in the bottom of the tub adjacent the heat susceptor; and (d) a lid inside the tub positioned over the popping corn, the lid having a rim in sliding engagement with the walls of the tub, the lid being movable upwardly under expansion forces generated from heating the popping corn.

* * * * *